US005279059A

United States Patent [19]

Howard

[11] Patent Number: 5,279,059

[45] Date of Patent: Jan. 18, 1994

[54] DUAL MAGAZINE ASSEMBLY AND HOLDER THEREFOR

[76] Inventor: William J. Howard, P.O. Box 573, Wilson, N.C. 27893

[21] Appl. No.: 13,924

[22] Filed: Feb. 5, 1993

[51] Int. Cl.[5] ..... F41A 9/68

[52] U.S. Cl. ..... 42/90; 42/50

[58] Field of Search ..... 42/49.01, 49.02, 50, 42/90

[56] References Cited

U.S. PATENT DOCUMENTS

| | | | |
|---|---|---|---|
| 3,190,023 | 6/1965 | Reed | 42/18 |
| 3,623,256 | 11/1971 | Shiplee | 42/50 |
| 4,447,976 | 5/1984 | Cooper | 42/49.02 |
| 4,484,403 | 11/1984 | Schwaller | 42/50 |
| 4,484,404 | 11/1984 | Johnson | 42/90 |
| 4,628,627 | 12/1986 | Johnson | 42/90 |
| 4,685,238 | 8/1987 | Schoepflin | 42/90 |

OTHER PUBLICATIONS

"The Shotgun News"- Hastings Nebraska, May 20, 1990 (Exc) p. 132 disclosing the Israeli Dual Magazine Holder.

Exhibit D Photo of prior art device assembled.

Exhibit E Photo of prior art device Disassembled.

*Primary Examiner*—Stephen C. Bentley

*Attorney, Agent, or Firm*—David R. Murphy

[57] ABSTRACT

Described is a dual magazine assembly comprising a left magazine and a right magazine held together by a holder. The assembly permits either magazine to be received by a firearm even when the firearm has only a single magazine port. The holder comprises a female half, and a male half.

The female half has a plate with left and right extensions for engaging the left and right magazines. The female half also has a tube perpendicular to the plate and integral with it. The tube has a hook-receiving surface.

The male half also has a plate with left and right extensions for engaging the left and right magazines. It carries a prong adapted to mate with the tube of the female half. The prong has a manually releasable hook at its extremity. The hook overrides the ramp and engages the hook-receiving surface of the female half thereby holding the two halves together.

11 Claims, 2 Drawing Sheets

DUAL MAGAZINE ASSEMBLY AND HOLDER THEREFOR

Figure 1:
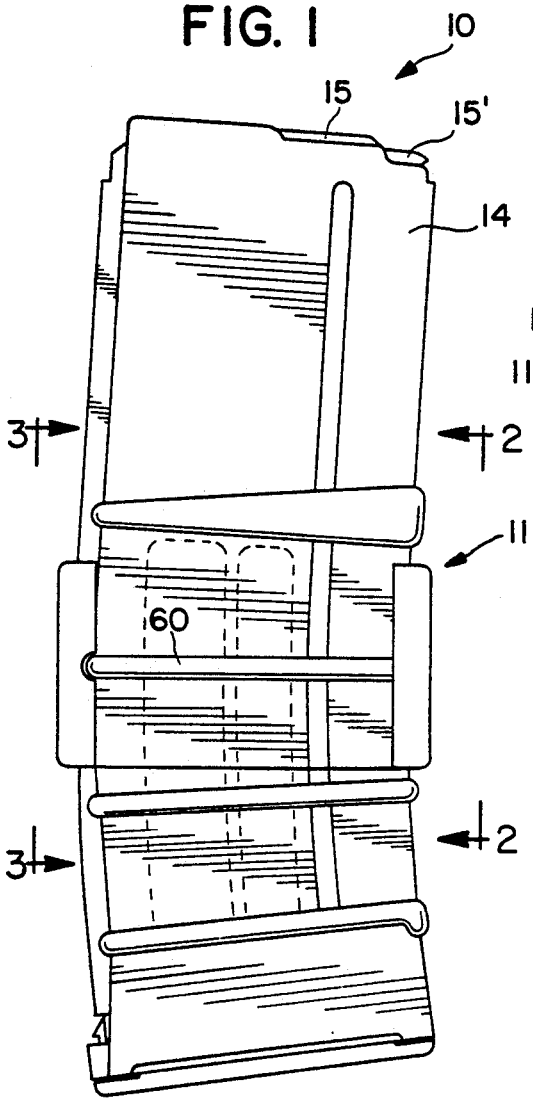

Dual magazine assemblies are devices which are notoriously well known in the art. These assemblies include a device called a holder for coupling together two or more magazines so that the combatant or sportsman will have immediately available two rather than only one magazine for use with the rifle in hand.

Such dual magazine assemblies are described, for example in Reed U.S. Pat. No. 3,190,023; Cooper U.S. Pat. No. 4,447,976; Schwaller U.S. Pat. No. 4,484,403; Johnson U.S. Pat. No. 4,484,404; Johnson U.S. Pat. No. 4,628,627 and in Schoepflin U.S. Pat. No. 4,685,238. An advertisement on Page 132 of the May 20, 1990, issue of "THE SHOTGUN NEWS" discloses certain dual magazine holders that it says "were made for the Israeli Army and are an official issue item . . . ". The advertisement also says that the holder is "For Aluminum Magazines Only" and that it "will not work with nylon mags" i.e. nylon or other plastic magazines.

In addition to not being useful with thermoplastic magazines, the above listed and other prior art devices suffer from a wide variety of disadvantages and limitations.

Some prior art devices undesirably require the use of a wrench, screw driver or other tool to assemble or disassemble them. The required presence of any special tool in a combat situation is highly undesirable.

Many prior art devices employ a bolt or other shaft with threads adapted to receive a nut or a thumbscrew to keep the assembly tight. Threads are expensive to manufacture. Threads can be easily damaged in the field with the result that an assembled device cannot be disassembled or vice versa. Constant attention is required on the thumbscrews to keep the assembly from falling apart. Thumbscrews are difficult or impossible to operate with cold or injured fingers or when wearing gloves.

Many prior art devices are made of metal such as iron, stainless steel or aluminum. All these metals are undesirably light-reflective. Combatants do not wish to have light reflecting from their weapons. Painting temporarily renders these devices non light-reflective, but not when the paint wears off and not when the device is scratched. Iron rusts. Stainless steel is expensive and difficult to work.

Many prior art devices disassemble into five or more parts. The inadvertent loss of any one of these parts can render the device useless.

Many prior art devices must be manufactured by costly metal stamping techniques. No prior art device has two and only two parts that can be economically produced by the injection molding of nylon or other thermoplastic.

Accordingly it is an object of the present invention to provide an improved dual magazine assembly and holder therefor which is substantially free of one or more of the disadvantages of prior devices.

Another object is to provide an improved holder which is useful with thermoplastic magazines including those of nylon.

Another object is to provide an improved holder which does not require the use of a screw driver or other tool for either assembly or disassembly.

Another object is to provide an improved holder which contains no threads, no nuts, no bolts and no thumbscrews.

Another object is to provide an improved holder which does not require the use of any iron, aluminum, stainless steel or other metal and can be constructed completely of organic thermoplastic such as nylon.

Another object is to provide an improved holder which in non light-reflective without being painted and never requires painting.

Another object is to provide an improved holder which consists of two and only two parts and which can be manufactured by injection molding.

Figure 2:
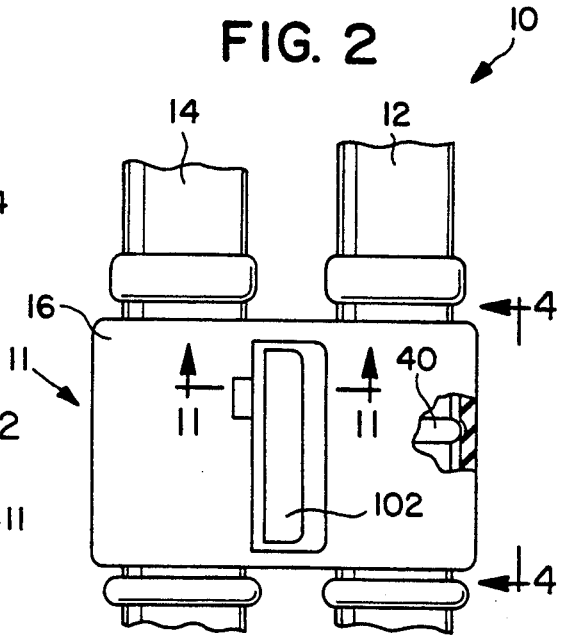
Figure 3:
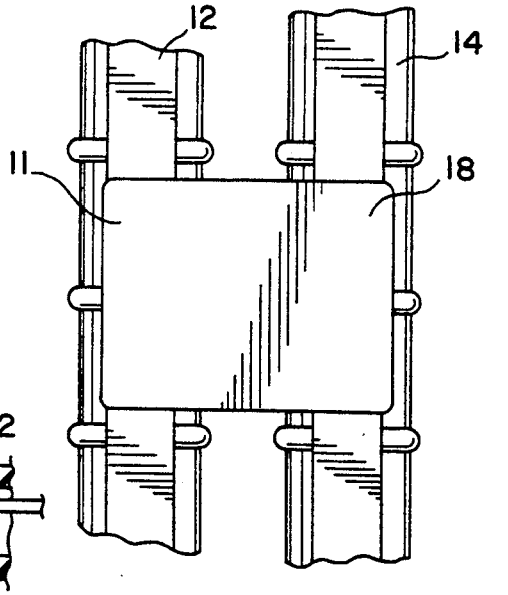
Figure 11:
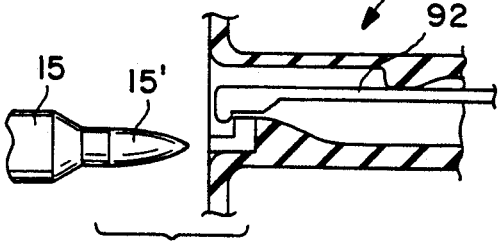
Figure 4:
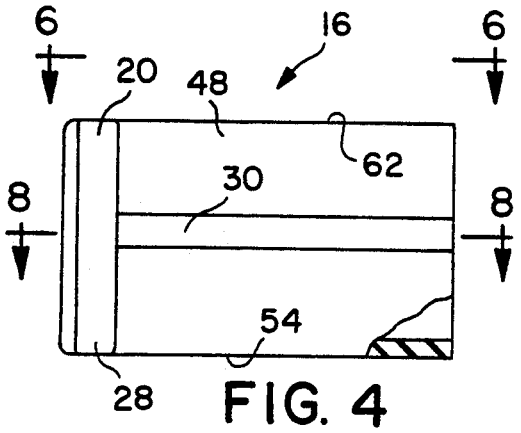
Figure 5:
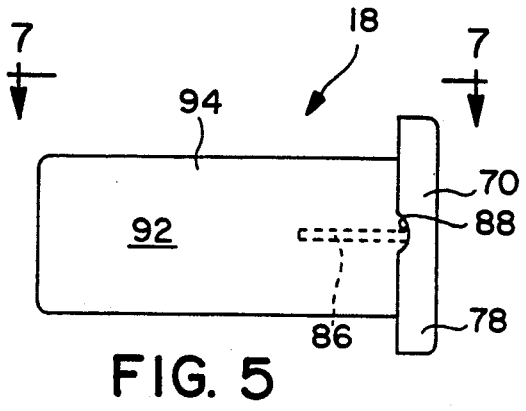
Figure 6:
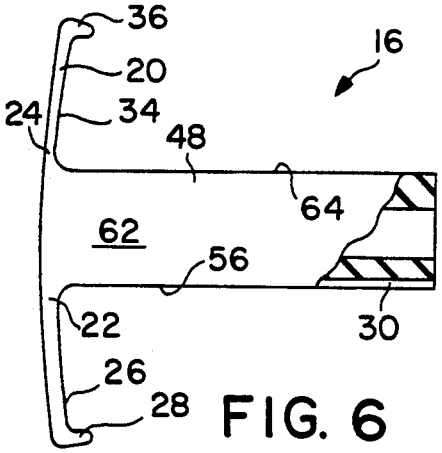
Figure 7:
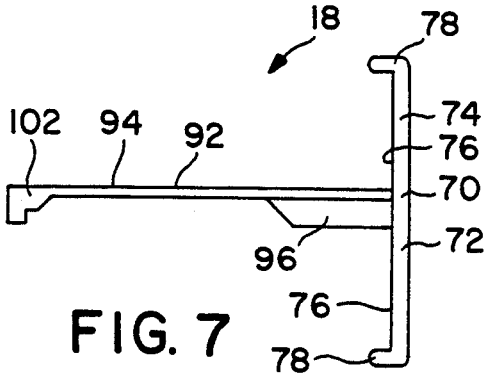
Figure 8:
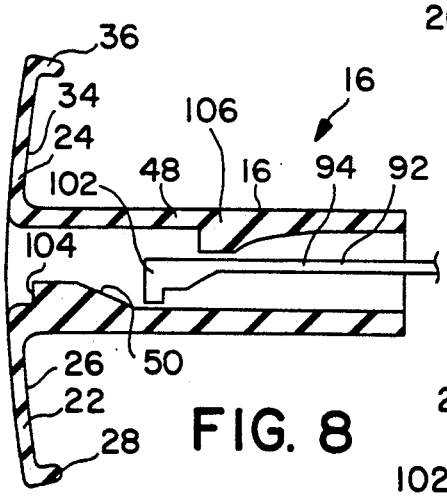
Figure 9:
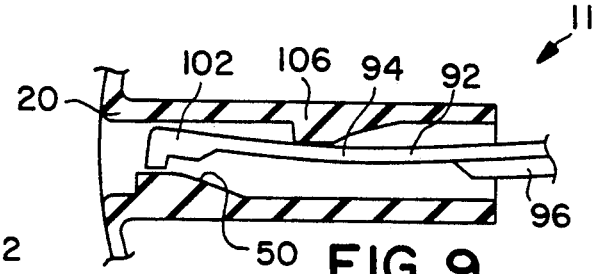
Figure 10:
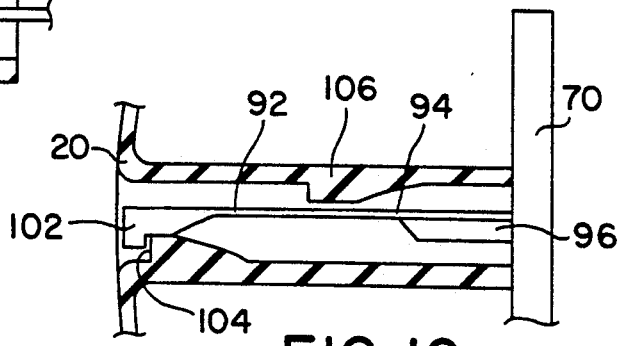

The invention may be better understood by reference to the following drawings wherein:

FIG. 1 is a side view of a dual magazine assembly of the present invention, including a holder of the present invention; and FIG. 2 is a partially cut away, partial sectional view taken along Line 2—2 of FIG. 1; and FIG. 3 is a partial, sectional view taken along Line 3—3 of FIG. 1; and FIGS. 4 and 5 together constitute an exploded view of a holder of the present invention, taken along line 4—4 of FIG. 2 but with the female half of the holder shown in FIG. 4 and the male half of the holder, including a prong shown, in FIG. 5; and FIG. 6 is a partially cut away view of the female half of the holder taken along Line 6—6 of FIG. 4; and FIG. 7 is a view of the male half of the holder taken along Line 7—7 of FIG. 5; and FIG. 8 is a sectional view of a holder of the present invention taken along Line 8—8 of FIG. 4 but with the prong partially inserted; and FIG. 9 is a sectional view similar to that of FIG. 8 but wherein the prong is inserted further than in FIG. 8; and FIG. 10 is a sectional view similar to that of FIGS. 8 and 9, but wherein the prong is fully inserted; and FIG. 11 is a sectional view taken along line 11—11 of FIG. 2 showing a projectile about to be inserted into the holder of the present invention for disassembly.

The above and other objects are accomplished according to the present invention by providing a dual magazine assembly comprising a left magazine and a right magazine held together by a holder. The assembly permits either magazine to be received by a firearm even when the firearm has only a single magazine port. The assembly comprises a left magazine, a right magazine, and a holder. The holder comprises a female half, and a male half.

The female half has a plate with left and right extensions for respectively engaging the left and right magazines. The female half also has a tube perpendicular to the plate and integral with it. The tube has a hook-receiving surface.

The male half also has a plate with left and right extensions for engaging the left and right magazines. It carries a prong adapted to mate with the tube of the female half. The prong comprises a spring attached to and integral with the male plate, and a manually releasable hook at the extremity of the prong. The hook overrides the ramp and engages the hook-receiving surface thereby holding together the male half and the female half.

Referring now to the drawings in general, and in particular to FIGS. 1, 2, and 3, there is shown a dual magazine assembly 10, of the present invention. The assembly 10 comprises a holder 11 holding a left magazine 12, and a right magazine 14. The right magazine 14 carries a number of cartridges such as the cartridge 15 having projectile 15'.

Referring now to FIGS. 4 through 7, it can be seen that the holder 11 consists of two and only two parts. One half is the female half 16. The other half is the male half 18.

The female half 16 comprises a female plate 20 having a left extension 22 and a right extension 24. The left extension 22 has a smooth, magazine-engaging left inner planar surface 26 terminating in a short left return 28. The left return 28 is substantially perpendicular to the left inner planar surface 26.

The female half 16 carries a left rib-receiving recess 30 in the left inner planar surface 26. The left rib-receiving recess 30 is adapted to receive and fixedly hold an external rib 60 of the left magazine 12. (See FIG. 1)

Similarly the right extension 24 has a smooth, magazine-engaging right inner planar surface 34 terminating in a short right return 36 perpendicular to the right inner planar surface 34. The right extension 24 carries a right rib-receiving recess (not shown) in the right inner planar surface 34. The right rib-receiving recess (not shown) is adapted to receive and fixedly hold an external rib (not shown) of the right magazine 14.

The female half 16 carries a rectangular tube 48 perpendicular to the female plate 20 and integral with the female plate 20. The inside of the tube 48 carries a hook-engaging ramp 50. (See FIG. 8)

The outer surface of the tube 48 comprises a lower minor planar surface 54; a left major planar surface 56 having a rib-receiving recess 30 adapted to receive and fixedly hold an external rib 40 of the left magazine 12. (See FIG. 2) The left major planar surface 56 is attached to the lower minor planar surface 54. An upper minor planar surface 62 is attached to the left major planar surface 56.

The right major planar surface 64 has a rib-receiving recess (not shown), similar to the recess 30, adapted to receive and fixedly hold an external rib 60 (See FIG. 1) of the right magazine 14. The right major planar surface 64 is attached to the upper minor planar surface 62.

As shown in FIGS. 5 and 7, the male half 18 comprises a male plate 70 having a left extension 72 and a right extension 74. The left extension 72 has a smooth, magazine-engaging left inner planar surface 76, terminating in a short left return 78 perpendicular to the left inner planar surface 76. There is a left rib-receiving recess 88 in the left return 78. The left rib-receiving recess 88 is adapted to receive and fixedly hold the external rib 40 of the left magazine 12.

Similarly the right extension 74 has a smooth, magazine-engaging right inner planar surface 76 terminating in a short right return 78 perpendicular to the right inner planar surface 76. The right extension 74 also has a right rib-receiving recess (not shown) in the right return 78. The right rib-receiving recess (not shown) is adapted to receive and fixedly hold an external rib 60 of the right magazine 14. (See FIG. 1)

The male half 18 carries a prong 92 adapted to mate with the female half 16. The prong 92 comprises a spring 94 attached to and integral with the male plate 70 at the center of the male plate 70. There is a stiffener 96 attached to the center of the male plate 70 and to that portion of the spring 94 adjacent to the male plate 70. The stiffener 96 increases the resistance to bending of the spring 94 in the vicinity of the stiffener 96. The stiffener 96 also reduces any tendency for the prong 92 to stress crack where the prong 92 joins the male plate 70. The prong 92 also has a manually releasable hook 102 which slides on the inner surface of the tube 48 such that the manually releasable hook 102 overrides the ramp 50 and prevents disengagement of the female half 16 from the male half 18 as long as the manually releasable hook 102 is on the far side of the ramp 50.

Referring now to FIGS. 8, 9, and 10 it can be seen how simple is the assembly of the holder 11 of the present invention. In general, assembly of the holder 11 from the female half 16 and the male half 18 is achieved by inserting the prong 92 of the male half 18 into the tube 48 of the female 16 until the hook 102 traverses the ramp 50 and engages a prong-retaining surface 104 carried by the female half 16.

In FIG. 8 the prong 92 has been inserted into the tube 98 until the hook 102 just begins to contact the ramp 50. In this position a biaser 106 just contacts the back of the spring 94.

In FIG. 9 the prong 92 has been inserted into the tube 98 until the hook 102 has ridden to the top of the ramp 50. In this position the biaser 106 causes the spring 94 to bend as shown and causes the hook 102 to be biased toward the top of the ramp 50.

In FIG. 10 the prong 92 has been fully inserted into the tube 98 until the hook 102 has ridden all the way over the ramp 50. In this position the biaser 106 forces the hook 102 downward causing the hook 102 to contact the prong-retaining surface 104. After the hook 102 overrides the ramp 50, it prevents disengagement of the female half 16 from the male half 18 as long as the hook 102 is on the far side of the ramp 50. The biaser 106 keeps the holder 11 in this position until disassembled.

As shown in FIG. 11 disassembly of the holder 11 is achieved by lifting the prong 92 from the prong-retaining surface 104 and sliding the prong 92 away from the prong-retaining surface 104. In this manner the hook 102 is manually releasable by the use of light digital pressure applied with the thumb or a finger. No tool is required to lift the prong 92. Cartridges are always at hand in the field and therefore do not constitute a "tool" as that term is used herein. However a projectile 15, can be used if desired to pry up the hook 102.

A wide variety of materials can be used to construct the holder of the present invention. It can even be made of metal. However the greatest number of advantages of the present invention are realized when the holder is constructed of thermoplastic. Organic thermoplastics are preferred because they can be injection molded. A wide variety of organic thermoplastics are suitable such as polyethylene, polypropylene, polyethylene terephthalate and nylon which is most preferred. When the holder 11 is constructed of organic thermoplastic, it is of course, completely free of metal.

The holder 11 is most preferably constructed solely of a thermoplastic composition of matter of about 35 weight percent glass fibers, one weight percent carbon black, with the balance essentially nylon. The presence of carbon black in the composition gives the holder 11 a black color and makes it completely non-reflective to light.

The devices of the present invention are useful with a wide variety of magazines. They are particularly useful with the standard North Atlantic Treaty Organization (NATO) issue M-16 thirty round magazine. The devices of the present invention are most particularly useful with the nylon magazines described in Howard U.S. Pat. Nos. 4,777,752 and 5,149,897.

It is apparent that the improved dual magazine holder is simple but effective. It has only two parts namely a female half 16 and a male half 18. The improved holder has many advantages of prior devices. The improved holder can be made of nylon and can be used with nylon magazines. The improved holder can be disassembled as described with respect to FIG. 11 with only the use of the fingers or possibly a projectile 15'. No screw driver or other tool is required for either assembly or disassembly. The improved holder has no threads, no nuts, no bolts and no thumbscrews. Finally the improved holder can be manufactured by injection molding.

The terms "left" and "right" are used interchangeably herein.

Although the invention has been described in great detail with respect to a preferred embodiment thereof, representing the best mode presently known, it will be understood that those skilled in the art can make modifications without departing from the spirit of the invention as described above and as defined in the appended claims.

What is claimed is:

1. A dual magazine assembly comprising a left magazine and a right magazine held together by a magazine holder while permitting either magazine to be received by a firearm which has only a single magazine port; said assembly comprising:

A. a left magazine; and

B. a right magazine; and

C. a holder comprising:

I. a female half having a plate with left and right extensions for respectively engaging the left and right magazines and having a tube perpendicular to the plate and integral with the plate said tube having a hook receiving ramp; and II. a male half having a plate with left and right extensions for respectively engaging the left and right magazines and having a prong adapted to mate with the tube of the female half said prong comprising:

a spring attached to and integral with the male plate; and a manually releasable hook at the extremity of the prong wherein the hook overrides the ramp thereby holding together the male half and the female half.

2. A magazine holder for holding a left magazine to a right magazine while permitting either magazine to be received by a firearm which has only a single magazine port; said holder comprising:

I. a female half having a plate with left and right extensions for respectively engaging the left and right magazines and having a tube perpendicular to the plate and integral with the plate said tube having a hook receiving ramp; and II. a male half having a plate with left and right extensions for respectively engaging the left and right magazines and having a prong adapted to mate with the tube of the female half said prong comprising:

a spring attached to and integral with the male plate; and a manually releasable hook at the extremity of the prong wherein the hook overrides the ramp thereby holding together the male half and the female half.

3. A magazine holder for holding a left magazine to a right magazine while permitting either magazine to be received by a firearm which has only a single magazine port; said holder comprising:

I. a female half having a plate with left and right extensions for respectively engaging the left and right magazines and having a tube perpendicular to the plate and integral with the plate said tube having a hook receiving ramp within the tube; and II. a male half having a plate with left and right extensions for respectively engaging the left and right magazines and having a prong adapted to mate with the tube of the female half said prong comprising:

a spring attached to and integral with the male plate at the center of the male plate; and a manually releasable hook at the extremity of the prong wherein the hook overrides the ramp and prevents disengagement of the male half from the female half while the hook engages the ramp.

4. The magazine holder of claim 1 wherein the hook overrides the ramp and prevents disengagement of the male half from the female half as long as the hook is on the far side of the ramp.

5. The magazine holder of claim 1 wherein said holder is constructed of an organic thermoplastic composition of matter.

6. The magazine holder of claim 1 wherein said holder is constructed solely of a thermoplastic composition of matter of nylon, glass fibers and carbon black.

7. The magazine holder of claim 1 wherein said composition is black and is completely non-reflective to light.

8. The magazine holder of claim 1 wherein said male half can be disengaged from said female half without the use of any tools.

9. The magazine holder of claim 1 wherein said holder is completely free of metal.

10. The magazine holder of claim 1 wherein said holder is completely free of any threaded connections.

11. A magazine holder for optionally, fixedly, securely holding two and only two standard magazines wherein one magazine is the left magazine and the other magazine is the right magazine while permitting either the left magazine or the right magazine to be received by a firearm adapted to accept one and only one magazine at a given time; said holder consisting of two and only two halves of which one half is a male half and the other half is a female half:

I. wherein said female half comprises:

A. a female plate having a left extension and a right extension; and wherein the left extension has a smooth, magazine-engaging left inner planar surface terminating in a short left return perpendicular to the left inner planar surface; a left rib-receiving recess in the left inner planar surface wherein said left rib-receiving recess is adapted to receive and fixedly hold an external rib of the left magazine; and wherein the right extension has a smooth, magazine-engaging right inner planar surface terminating in a short right return perpendicular to the right inner planar surface; a right rib-receiving recess in the right inner planar surface wherein said right rib-receiving recess is adapted to receive and fixedly hold an external rib of the right magazine; and B. a rectangular tube perpendicular to the female plate and integral with the female plate wherein the inside of the tube carries a hook-engaging ramp; and wherein the outer surface of the tube comprises a lower minor planar surface; and a left major planar surface having a rib-receiving recess adapted to receive and fixedly hold an external rib of the left magazine; said left major planar surface being attached to the lower minor planar surface; and an upper minor planar surface attached to the left major planar surface; and a right major planar surface having a rib-receiving recess adapted to receive and fixedly hold an external rib of the right magazine; said right major planar surface being attached to the upper minor planar surface; and II. wherein said male half comprises:

A. a male plate having a left extension and a right extension:

wherein the left extension has a smooth, magazine-engaging left inner planar surface terminating in a short left return perpendicular to the left inner planar surface; a left rib-receiving recess in the left return wherein said left rib-receiving recess is adapted to receive and fixedly hold an external rib of the left magazine; and wherein the right extension has a smooth, magazine-engaging right inner planar surface terminating in a short right return perpendicular to the right inner planar surface; a right rib-receiving recess in the right return wherein said right rib-receiving recess is adapted to receive and fixedly hold an external rib of the right magazine; and B. a prong adapted to mate with the female half said prong comprising:

a spring attached to and integral with the male plate at the center of the male plate; and a stiffener attached to the center of the male plate and to the spring adjacent to the male plate wherein the stiffener increases the resistance to bending of the spring in the vicinity of the stiffener; and a head at the extremity of the prong said head comprising a slide and a manually releasable hook wherein the slide slides on the inner surface of the tube and wherein the manually releasable hook overrides the ramp and prevents disengagement of the male half from the female half as long as the manually releasable hook is on the far side of the ramp; and wherein said holder is constructed solely of a thermoplastic composition of matter of nylon, glass fibers and carbon black; and wherein said composition is black and is completely non-reflective to light; and wherein said male half can be disengaged from said female half without the use of any tools; and wherein said holder is completely free of metal; and wherein said holder is completely free of any threaded connections; and whereupon assembly of the holder from the female half and the male half is achieved by inserting the prong of the male half into the tube of the female half until the hook traverses the ramp and engages a prong-retaining surface carried by the female half; and whereupon disassembly of the holder is achieved by lifting the prong from the prong-retaining surface and sliding the prong away from the prong retaining surface thereby releasing the manually releasable hook.

* * * * *